US010407763B2

(12) United States Patent
Kim

(10) Patent No.: US 10,407,763 B2
(45) Date of Patent: Sep. 10, 2019

(54) CARBON STEEL COMPOSITION FOR REDUCED THERMAL STRAIN STEERING RACK BAR AND METHOD FOR MANUFACTURING SAME

(71) Applicant: Hyundai Motor Company, Seoul (KR)

(72) Inventor: Hyun-Kyu Kim, Anyang-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 804 days.

(21) Appl. No.: 14/946,164

(22) Filed: Nov. 19, 2015

(65) Prior Publication Data

US 2016/0305008 A1 Oct. 20, 2016

(30) Foreign Application Priority Data

Apr. 14, 2015 (KR) ..... 10-2015-0052528

(51) Int. Cl.

| | |
|---|---|
| ***C23C 8/26*** | (2006.01) |
| ***C21D 6/00*** | (2006.01) |
| ***C22C 38/26*** | (2006.01) |
| ***C22C 38/24*** | (2006.01) |
| ***C22C 38/06*** | (2006.01) |
| ***C22C 38/04*** | (2006.01) |
| ***C22C 38/02*** | (2006.01) |

(52) U.S. Cl.

CPC ..... *C23C 8/26* (2013.01); *C21D 6/002* (2013.01); *C21D 6/005* (2013.01); *C21D 6/008* (2013.01); *C22C 38/02* (2013.01); *C22C 38/04* (2013.01); *C22C 38/06* (2013.01); *C22C 38/24* (2013.01); *C22C 38/26* (2013.01)

(58) Field of Classification Search

CPC ..... C21D 6/002; C21D 6/005; C21D 6/008; C22C 38/24

USPC ..... 420/103

See application file for complete search history.

(56) References Cited

U.S. PATENT DOCUMENTS

| | | | | |
|---|---|---|---|---|
| 9,976,206 | B2 * | 5/2018 | Egashira | C22C 38/00 |
| 2013/0180626 | A1 * | 7/2013 | Yoshida | C21D 1/32 148/219 |

FOREIGN PATENT DOCUMENTS

| | | |
|---|---|---|
| EP | 2 546 374 A1 | 1/2013 |
| JP | 3438282 | 7/1995 |
| JP | 2003-243215 | 8/2003 |
| JP | 5325432 | 7/2013 |
| JP | 2015-062920 A | 4/2015 |

(Continued)

*Primary Examiner* — Jie Yang

(74) *Attorney, Agent, or Firm* — Brinks Gilson & Lione

(57) ABSTRACT

The present disclosure provides a carbon steel composition for a reduced thermal strain steering rack bar and a method for manufacturing the carbon steel composition. The carbon steel composition for a steering rack bar includes: iron (Fe) as a main component, about 0.39 to 0.43 wt % of carbon (C), approximately 0.15 to 0.35 wt % of silicon (Si), approximately 0.90 to 1.10 wt % of manganese (Mn), approximately 0.02 to 0.04 wt % of niobium (Nb), and approximately 0.10 to 0.15 wt % of vanadium (V). The method for manufacturing a carbon steel composition for a steering rack bar includes: filling and drawing the carbon steel composition; broaching the filled and drawn carbon steel composition; performing nitriding heat-treatment on a surface of the broached carbon steel composition; and inspecting the nitriding heat-treated carbon steel composition.

2 Claims, 4 Drawing Sheets

(56) References Cited

FOREIGN PATENT DOCUMENTS

| | | | | |
|---|---|---|---|---|
| KR | 10-2012-0130172 | | 11/2012 | |
| WO | WO-2015029553 | A1 * | 3/2015 | ..... C22C 38/00 |

* cited by examiner

Fig. 1 "Prior Art"

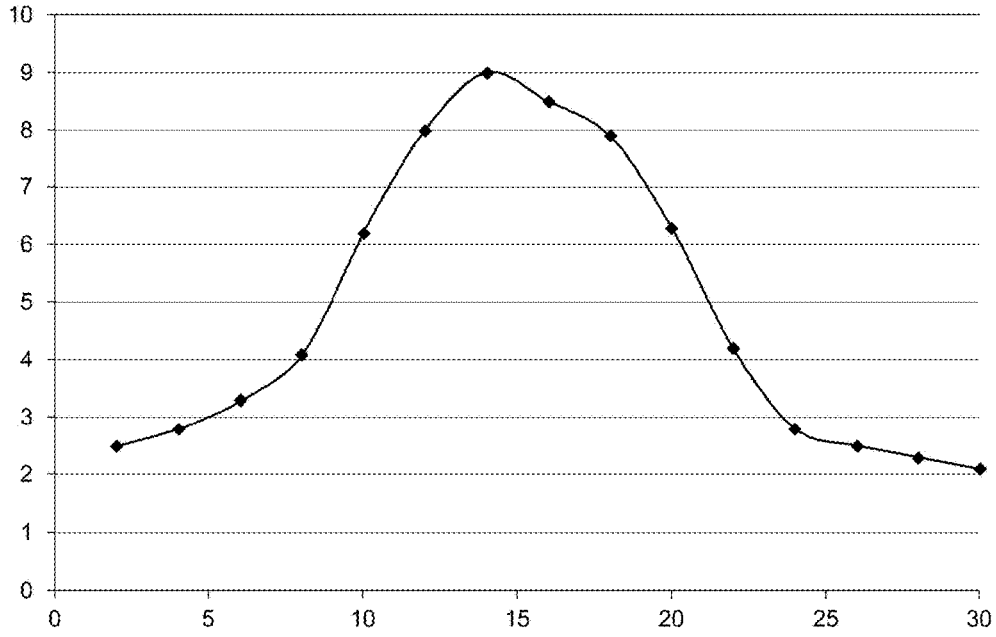
Fig. 4
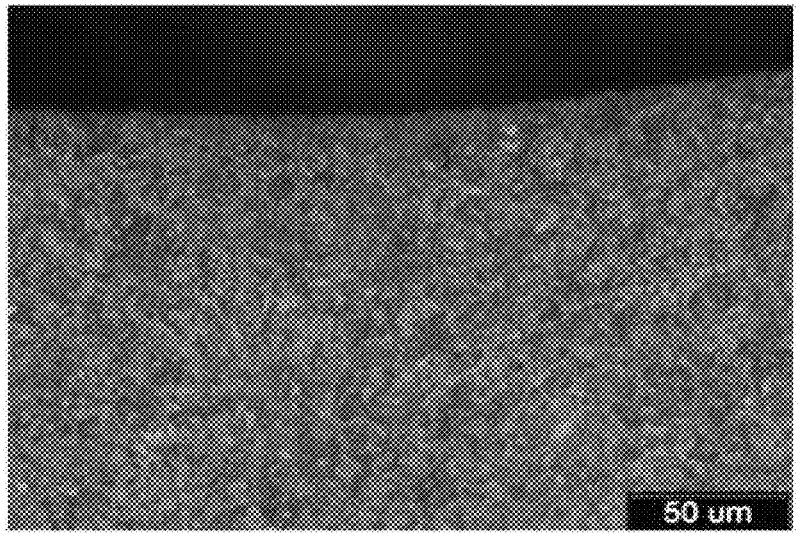
Fig. 5 "Prior Art"

CARBON STEEL COMPOSITION FOR REDUCED THERMAL STRAIN STEERING RACK BAR AND METHOD FOR MANUFACTURING SAME

CROSS-REFERENCE TO RELATED APPLICATIONS

This application claims the benefit of Korean Patent Application No. 10-2015-0052528, filed on Apr. 14, 2015, which is hereby incorporated by reference in its entirety

FIELD

The present disclosure relates to a carbon steel composition for a reduced thermal strain steering rack bar and a method for manufacturing the same.

BACKGROUND

The statements in this section merely provide background information related to the present disclosure and may not constitute prior art.

Recently, an environmental problem has been on the rise around the globe, and thus a method of reducing fuel to cope with this problem encompassing all industries has been sought. In order to reduce fuel, examples of a solution proposed in a vehicle industrial field include improving efficiency of a vehicle engine and a weight reduction in vehicles. By reducing the weight of vehicles, this helps increase fuel efficiency of the vehicle. However, when reducing the weight of vehicles, there occurs a problem in that strength and durability required in vehicles are not satisfied. Therefore, it is the greatest goal of a vehicle industry to solve this.

Generally, a steering rack bar of the vehicle is a part of a device adjusting an angle of a shaft of the vehicle so that a progress direction of the vehicle is changed according to an operation of a driver. FIG. 1 is a perspective view of a steering gear box assembly and a rack bar. If a steering handle is rotated, rotation force is transferred through a steering main shaft of a steering column 100 to a universal joint 200, and rotation force transferred to the universal joint 200 may be transferred through a pinion gear and a rack gear in a gear box 300 to a wheel of the vehicle to change the progress direction of the vehicle.

The rack gear is connected to a rack bar 400. In addition, the rack bar 400 receives rotation force from the pinion gear. The rack bar 400 corresponds to a device changing a steering angle of the wheel of the vehicle and thus changes the angle of the wheel of the vehicle so that the driving course of a vehicle is changed.

As described above, since the steering rack bar receives a load of the vehicle, a material for the steering rack bar needs to have high strength and a property enduring pulling force, that is, toughness which is sufficiently high. In addition, in the case where the vehicle runs on a road, if the steering rack bar is broken, there occurs a large problem in a safety risk to a driver, and thus the material of the steering rack bar needs to have high strength and sufficient impact strength. Further, in the case where the steering rack bar is manufactured, since a carbon steel composition needs to be subjected to cutting processing, a property of easily performing such processing is also desired.

In order to satisfy the aforementioned requirement, in the related art, two solutions are proposed. A first solution is to develop a high strength material. In addition, a second solution is a method of increasing a diameter of the steering rack bar.

In the related art, in a method of developing the high strength material, the high strength material developed in the related art has problems in that due to high strengthening, impact strength and processability are reduced and a thermal strain occurs.

In the related art, a method of increasing the diameter of the steering rack bar is used to improve strength, toughness, and impact strength of the steering rack bar. However, if the diameter of the steering rack bar is increased and thus a volume of the rack bar is increased, there is a design limitation of parts due to interference with peripheral parts. Further, there are other problems. If a weight of the steering rack bar is increased, a steering quality of the vehicle is reduced and fuel efficiency is reduced.

In addition to this, recently, in accordance with appearance of a technology such as R-MDPS (motor driven power steering R type), a high strength material capable of being applied to high torque has been required. Therefore, the method of simply increasing the diameter of the steering rack bar in the related art cannot be applied.

Additionally, in the related art, in order to achieve high strength of the steering rack bar, high frequency heat-treatment is performed to secure strength. However, if heat-treatment is performed before the cutting process, due to high strengthening of the material, it is difficult to perform the processing, and a thermal strain of the material occurs, and thus additional calibration is required. Accordingly, a production time increases, and thus production efficiency decreases and production costs increase.

SUMMARY

The present disclosure provides a carbon steel composition for a reduced thermal strain steering rack bar, which reduces a production process by increasing strength of the carbon steel composition and reducing a thermal strain through nitriding heat-treatment change, and a method for manufacturing the same.

The present disclosure has been made in an effort to increase safety of a vehicle by securing strength of the steering rack bar and reduce production costs of the vehicle by increasing production efficiency.

An exemplary form of the present disclosure provides a carbon steel composition for a steering rack bar, including: iron (Fe) as a main component, carbon (C) of approximately 0.39 to 0.43 wt %, silicon (Si) of approximately 0.15 to 0.35 wt %, manganese (Mn) of approximately 0.90 to 1.10 wt %, niobium (Nb) of approximately 0.01 to 0.02 wt %, and vanadium (V) of approximately 0.10 to 0.15 wt %.

In the present disclosure, the composition for the steering rack bar may further include chromium (Cr).

In the present disclosure, a content of chromium (Cr) may be approximately 1.00 to 2.00 wt %.

In the present disclosure, the carbon steel composition for the steering rack bar may further include aluminum (Al).

In the present disclosure, a content of aluminum (Al) may be approximately 0.08 to 0.14 wt %.

In the present disclosure, the carbon steel composition for the steering rack bar may further include chromium (Cr) and Aluminum (Al).

In the present disclosure, a content of chromium (Cr) may be approximately 1.00 to 2.00 wt %, and a content of aluminum (Al) may be 0.08 to 0.14 wt %.

Another exemplary form of the present disclosure provides a steering rack bar manufactured by the carbon composition for the steering rack bar.

Yet another exemplary form of the present disclosure provides a method for manufacturing a carbon steel composition for a steering rack bar, including: filling and drawing the carbon steel composition; broaching the filled and drawn carbon steel composition; performing nitriding heat-treatment on a surface of the broached carbon steel composition; and inspecting the nitriding heat-treated carbon steel composition.

In the present disclosure, in the manufacturing method, the carbon steel composition may include iron (Fe) as a main component, carbon (C) of approximately 0.39 to 0.43 wt %, silicon (Si) of approximately 0.15 to 0.35 wt %, manganese of approximately 0.90 to 1.10 wt %, niobium (Nb) of approximately 0.02 to 0.04 wt %, and vanadium (V) of approximately 0.10 to 0.15 wt %.

In the present disclosure, in the manufacturing method, the carbon steel composition may further include chromium (Cr) of approximately 1.00 to 2.00 wt %.

In the present disclosure, in the manufacturing method, the carbon steel composition may further include aluminum (Al) of approximately 0.08 to 0.14 wt %.

In the present disclosure, in the manufacturing method, the carbon steel composition may further include aluminum of approximately 0.08 to 0.14 wt % and chromium (Cr) of approximately 1.00 to 2.00 wt %.

According to a carbon steel composition for a steering rack bar of the present disclosure, there is provided the carbon steel composition which is a material for the steering rack bar increasing safety of a vehicle by increasing strength of the carbon steel composition and thus securing strength required in the steering rack bar.

According to a method for manufacturing a steering rack bar of the present disclosure, there is provided a manufacturing method where a portion of vehicle production steps can be omitted by reducing a thermal strain and reducing a production process in the related art. Moreover, since heat-treatment before processing is omitted, it is easy to process a carbon steel composition, and since a production procedure is omitted, a production time and production costs are reduced.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 4 is a graph illustrating subcomponent static strength according to a nitride index according to an exemplary form of the present disclosure;

FIG. 5 is an enlarged picture of a material cross-section, which illustrates a material strain after high frequency heat-treatment according to an exemplary form of the related art.

Figure 1:
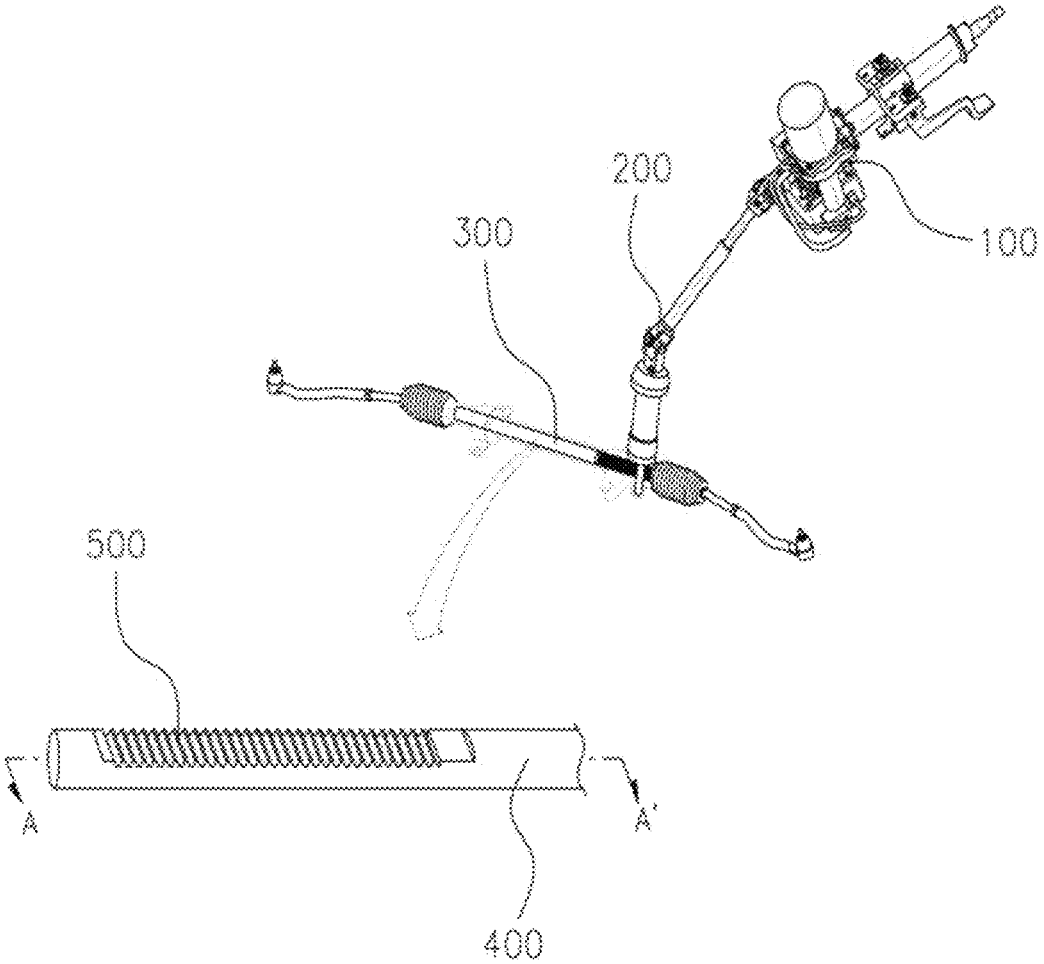
FIG. 1 is a perspective view of a steering gear box assembly and a rack bar according to the related art.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, exemplary forms of a carbon steel composition for a reduced thermal strain steering rack bar of the present disclosure and a method for manufacturing the same will be described in detail with reference to the accompanying drawings. Prior to this, terms or words used in the present specification and claims should not be interpreted as being limited to typical or dictionary meanings, but should be interpreted as having meanings and concepts which comply with the technical spirit of the present disclosure, based on the principle that an inventor can appropriately define the concept of the term to describe his/her own present disclosure in the best manner. Therefore, it should be understood that there are various equivalents and modifications replacing the forms at the time of filing of the present application.

The present disclosure relates to a carbon steel composition for a reduced thermal strain steering rack bar, and a method for manufacturing the same. Hereinafter, the present disclosure will be described.

Table 1 relates to a component ratio of a carbon steel composition in the related art. The carbon steel composition for the steering rack bar, which is the related art, is manufactured at the component ratio as described in the following Table 1. A unit corresponds to wt % and the residue includes iron (Fe) as a main component.

TABLE 1

| Classification | C | Si | Mn | P | S | Cu | Ni | V |
|---|---|---|---|---|---|---|---|---|
| S45C-D | 0.44 to 0.48 | 0.15 to 0.35 | 0.60 to 0.90 | 0.03 or less | 0.035 or less | — | — | — |
| S45C-VD | 0.44 to 0.48 | 0.15 to 0.35 | 1.11 to 1.40 | 0.03 or less | 0.03 to 0.07 | 0.30 or less | 0.20 or less | 0.08 to 0.09 |

The carbon steel composition for the steering rack bar is mainly used as a material having tensile strength of 700 MPa. Generally, in order to manufacture the steering rack bar, a cutting process is directly performed in a material state. Since the rack bar receives a load inputted from a wheel of a vehicle, strength needs to be increased in order to support the load. In order to solve this, a method of increasing strength by performing high frequency heat-treatment on a surface is used. However, if high frequency heat-treatment is performed, the thermal strain occurs on a material as a side effect. If the thermal strain occurs in the steering rack bar, since safety of the vehicle may not be secured, a calibration operation thereof is desired.

Other alloy components are added in order to increase the strength of the material for the steering rack bar. However, there are problems in that if another component is added, a thermal strain amount is increased to increase a calibration time and thus reduce production efficiency and increase production costs.

In order to solve this, in the present disclosure, a carbon steel composition for the reduced thermal strain steering rack bar is proposed. Hereinafter, components of the carbon steel composition for the reduced thermal strain steering rack bar will be described in greater detail.

Table 2 relates to a component ratio of the carbon steel composition of the present disclosure. The carbon steel composition for the reduced thermal strain steering rack bar of the present disclosure is constituted by Fe (iron) as a main component, and additionally, C (carbon), Si (silicon), Mn (manganese), V (vanadium), Nb (niobium), Cr (chrome), and Al (aluminum). To be more specific, the carbon steel composition for the reduced thermal strain steering rack bar according to the present disclosure includes, referring to Table 2, iron (Fe) as the main component, approximately 0.39 to 0.43 wt % of carbon (C), approximately 0.15 to 0.35 wt % of silicon (Si), approximately 0.90 to 1.10 wt % of manganese (Mn), approximately 0.10 to 0.15 wt % of vanadium (V), approximately 0.02 to 0.04 wt % of niobium (Nb), approximately 1.00 to 2.00 wt % of chrome (Cr), and approximately 0.08 to 0.14 wt % of aluminum (Al). A unit is wt %.

TABLE 2

| | C | Si | Mn | Cr | V | Nb | Al |
|---|---|---|---|---|---|---|---|
| Present disclosure | 0.39 to 0.43 | 0.15 to 0.35 | 0.90 to 1.10 | 1.00 to 2.00 | 0.10 to 0.15 | 0.02 to 0.04 | 0.08 to 0.14 |

Carbon (C) is a component added in order to increase strength of the carbon steel. In one form, the content of carbon (C) is approximately 0.39 to 0.43 wt %. If the content of carbon (C) is less than 0.39 wt %, the carbon steel may not obtain sufficient strength. Further, there are problems in that if the content of carbon (C) is more than 0.43 wt %, hardness is increased and thus brittleness is increased. As a result, ductility and processability are reduced. Therefore, as compared to the related art, the component ratio of carbon (C) may be reduced to secure toughness with respect to an impact.

Silicon (Si) is a component added in order to secure deacidification and strength. In one form, the content of silicon (Si) is approximately 0.15 to 0.35 wt %. If the content of silicon (Si) is less than 0.15 wt %, it is difficult to secure deacidification and strength. Further, there is a problem in that if the content of silicon (Si) is more than approximately 0.35 wt %, strength of the carbon steel is excessively increased and thus reduces processability.

Manganese (Mn) is a component added to serve to micronize pearlite of the carbon steel and allow ferrite to be subjected to solid-solution strengthening and thus improve yield strength of the carbon steel. Therefore, Manganese (Mn) is the component added in order to prevent strength from being reduced due to reduction of a component ratio of carbon (C). In one form, the content of Manganese (Mn) is approximately 0.90 to 1.10 wt %. If the content of Manganese (Mn) is less than approximately 0.90 wt %, it is difficult to achieve sufficient yield strength. Further, there is a problem in that if the content of Manganese (Mn) is more than approximately 1.10 wt %, Manganese (Mn) may serve as a factor hindering toughness of the carbon steel.

Chromium (Cr) improves mechanical strength of a nitride layer of the carbon steel and forms a passive state coat to improve corrosion resistance. In addition, an interlamellar space of pearlite of the carbon steel is micronized. Therefore, in one form, the content of chromium (Cr) is approximately 1.00 to 2.00 wt %. If the content of chromium (Cr) is less than approximately 1.00 wt %, it is difficult to secure sufficient corrosion resistance. Further, there is a problem in that if the content of chromium (Cr) is more than approximately 2.00 wt %, ductility of the carbon steel may be weakened.

Vanadium (V) serves to increase an ability forming a carbide and manufacture sufficient fine carbide capable of improving strength and toughness of the carbon steel and thus refine a grain of the carbon steel. In another form, the content of vanadium (V) is approximately 0.10 to 0.15 wt %. If the content of vanadium (V) is less than approximately 0.10 wt %, it is difficult to refine the grain of the carbon steel. Further, there is a problem in that if the content of vanadium (V) is more than approximately 0.15 wt %, ductility of the carbon steel may be reduced.

Niobium (Nb) forms a nitride in the carbon steel and reduces brittleness at a temperature at which nitriding is performed. In one form, the content of niobium (Nb) is approximately 0.02 to 0.04 wt %. If the content of niobium (Nb) is less than approximately 0.02 wt %, the nitride is not formed in the carbon steel. Further, there is a problem in that if the content of niobium (Nb) is more than approximately 0.04 wt %, brittleness may be increased at a temperature at which the carbon steel is nitrided to break the material.

Aluminum (Al) serves to increase a thickness of the nitride layer. In one form, the content of Aluminum (Al) is approximately 0.08 to 0.14 wt %. If the content of Aluminum (Al) is less than approximately 0.08 wt %, since the thickness of the nitride layer is small, sufficient strength may not be secured. Further, there is a problem in that if the content of Aluminum (Al) is more than approximately 0.14 wt %, strength of the carbon steel may be increased but processability decreases.

Therefore, as compared to the related art, a property capable of easily forming the nitride layer is secured by reducing the component ratio of carbon (C), increasing the component ratios of manganese (Mn) and chromium (Cr), adding silicon (Si) in the same or similar content to increase a property enduring the impact, and adding vanadium (V), niobium (Nb), and Aluminum (Al).

The steering rack bar engages with a pinion gear to perform driving. Therefore, since much friction is applied to the steering rack bar, a material quality of a surface, that is, strength of the surface is an important factor in selection of the material of the steering rack bar. Therefore, a correlation between the thickness of the nitride layer and a surface hardness maintenance depth becomes important.

Hereinafter, the degree of nitriding and a property of the material according to the chromium (Cr) and aluminum (Al) contents will be reviewed in more detail while being compared to the related art.

In the case of chromium (Cr), if the content of chromium (Cr) is increased in the nitrided carbon steel, hardness and wear resistance of the nitride layer are increased, and scratch resistance is increased. However, there is a problem in that if chromium (Cr) is excessively added, the thickness of the nitride layer is reduced.

Aluminum (Al) is an element forming strongly the nitride, and as an addition amount of aluminum (Al) is increased, the thickness of the nitride layer is increased. However, there are problems in that if aluminum (Al) is excessively added, hardness is reduced and the nitride layer that is easily stripped is formed.

Reviewing the following Table 3, a property changed according to an increase in component ratio of chromium (Cr) and aluminum (Al) can be acknowledged. As the content of the chromium (Cr) component is increased, the thickness of the nitride layer is reduced and a curing depth is rapidly reduced. On the other hand as the chromium (Cr) component is increased, hardness of the surface is increased and the surface hardness maintenance depth is increased. Further, as the content of the aluminum (Al) component is increased, the thickness of the nitride layer is increased and surface hardness is also rapidly increased. However, the curing depth is at the same level or is reduced and the surface hardness maintenance depth is reduced (represented by '=↓').

TABLE 3

| Classification | | Thickness of nitride layer | Surface hardness | Surface hardness maintenance depth | Curing depth |
|---|---|---|---|---|---|
| Degree of influence of alloy element | Cr increase | ↓ | ↑ | ↑ | ↓↓ |
| | Al increase | ↑ | ↑↑ | ↓ | =↓ |

The following description corresponds to an experiment determining the appropriate range of the component ratios of aluminum (Al) and chromium (Cr) for finding the desired thickness of the nitride layer and surface hardness maintenance depth of the carbon steel composition according to the present disclosure. An experimental composition includes iron (Fe) as a main component, approximately 00.41 wt % of C, 0.25 wt % of silicon (Si), approximately 1.00 wt % of manganese (Mn), approximately 0.12 wt % of vanadium (V), and approximately 0.03 wt % of niobium (Nb). Thereafter, an appropriate range of the component ratios is found while the component ratios of aluminum (Al) and chromium (Cr) are changed.

Figure 2:
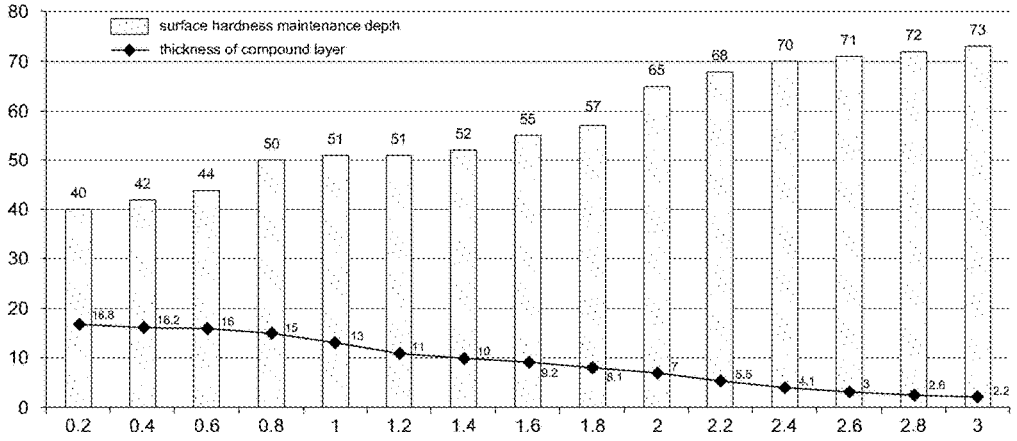
FIG. 2 is a graph illustrating a surface hardness maintenance depth and a thickness of a nitride layer exhibited while fixing a content of an aluminum (Al) component to approximately 0.1 wt % and changing a weight ratio of a chromium (Cr) component according to various exemplary forms of the present disclosure.

A horizontal axis of FIG. 2 corresponds to the component ratio of chromium (Cr), a unit corresponds to wt %, a vertical axis means a distance from the surface, and a unit corresponds to μm. The experiment is performed while the content of aluminum (Al) is fixed to approximately 0.1% and the component ratio of chromium (Cr) is changed. The experiment is performed while the component ratio of chromium (Cr) is increased approximately from 0.2 wt % to 3.0 wt % by 0.2 wt %, and in each experiment, the thickness of the nitride layer and the surface hardness maintenance depth can be confirmed. The thickness of a compound layer means the thickness of the nitride layer, and as the component ratio of chromium (Cr) is increased, the surface hardness maintenance depth is increased approximately from 40 μm to 73 μm, but the thickness of the compound layer, that is, the thickness of the nitride layer is reduced approximately from 16.8 μm to 2.2 μm.

Figure 3:
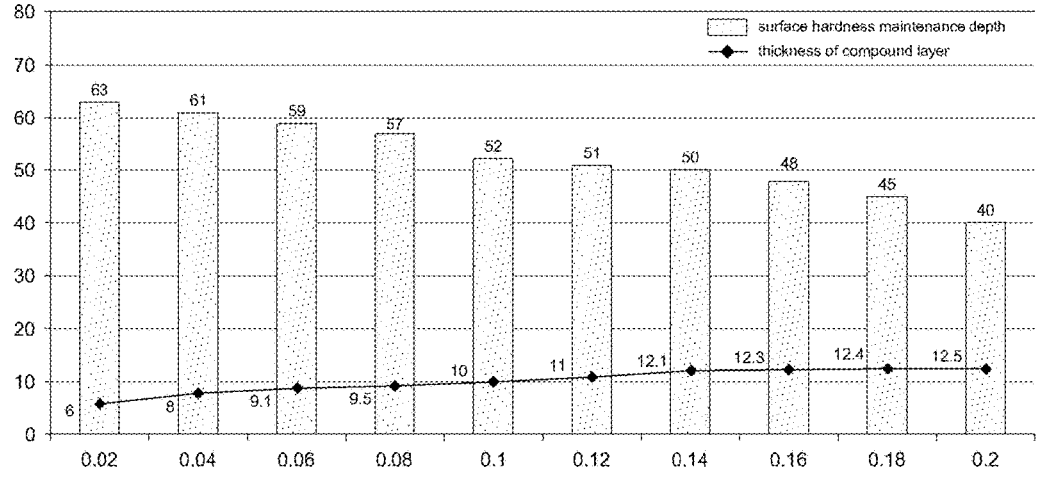
FIG. 3 is a graph illustrating the surface hardness maintenance depth and the thickness of the nitride layer exhibited while fixing a content of the chromium (Cr) component to approximately 1.4 wt % and changing a weight ratio of the aluminum (Al) component according to various exemplary forms of the present disclosure.

A horizontal axis of FIG. 3 corresponds to the component ratio of aluminum (Al), a unit corresponds to wt %, a vertical axis means a distance from the surface, and a unit corresponds to μm. The experiment is performed while the content of chromium (Cr) is fixed to approximately 1.4 wt % and the content of aluminum (Al) is increased approximately from 0.02 wt % to 0.2 wt % by approximately 0.02 wt % to measure the thickness of each compound layer, that is, the thickness of the nitride layer, and the surface hardness maintenance depth. The thickness of the compound layer, that is, the thickness of the nitride layer is increased approximately from 6 μm to 12.5 μm, but the surface hardness maintenance depth is reduced approximately from 63 μm to 40 μm.

A component range of the carbon steel composition for the reduced thermal strain steering rack bar according to the present disclosure is selected by a 'nitride index N'. The aforementioned index is an index exhibiting a change in physical properties according to the surface hardness maintenance depth and the chromium (Cr)/aluminum (Al) component ratio with respect to the nitride layer which are main physical properties when nitriding heat-treatment is performed, and the nitride index N corresponds to chromium (Cr)/aluminum (Al).

When $10<N<20$, the present disclosure has physical properties that the surface hardness maintenance depth is approximately 50 μm or more and the thickness of the nitride layer is approximately 7 μm or more, and thus static strength of the present disclosure may satisfy a strength property of approximately 6.0 kN of the material for the steering rack bar. When the index is approximately 10 or less, the thickness of the nitride layer is approximately 12 μm or more that is favorable but while the surface hardness maintenance depth is reduced to approximately 50 μm or less, strength of the material for the steering rack bar is reduced, and when the index is approximately 20 or more, the thickness of the surface hardness maintenance depth is approximately 65 μm or more in one form but the thickness of the nitride layer is reduced to approximately 7 μm, so that strength is significantly reduced to hinder satisfaction as the material for the steering rack bar. FIG. 4 corresponds to a view illustrating subcomponent static strength according to the nitride index. A horizontal axis corresponds to the nitride index, and a vertical axis is subcomponent static strength and a unit corresponds to kN. In FIG. 4, when the nitride index is between 10 and 20, subcomponent static strength is rapidly increased to satisfy 6 kN.

In another aspect, the present disclosure is a method relating to a process for manufacturing a steering rack bar through nitriding heat-treatment of a carbon steel composition for a reduced thermal strain steering rack bar.

In the related art, a process sequentially performing a step of filling/drawing an existing material for a steering rack bar; an SRA heat-treatment step; a broaching step; a high frequency heat-treatment step of a teeth surface; a high frequency heat-treatment step of a rear surface for 7 seconds; a calibration step for 40 seconds; and an inspection step is used. However, the heat-treatment step includes two steps of SRA (stress removal) heat-treatment and high frequency heat-treatment, and thus a production time is long. Further, there are problems in that since the thermal strain of the carbon steel composition occurs while high frequency heat-treatment is performed, calibration work thereof is required, and thus production efficiency is reduced and production costs are increased.

In order to solve the problems, in the present disclosure, from the aforementioned related art, the SRA (stress removal) heat-treatment step and the high frequency heat-treatment step are removed. Therefore, the thermal strain is reduced, and thus the calibration step may be omitted. However, a reduction in strength occurring when heat-treatment is omitted is solved by a method of using the carbon steel composition for the reduced thermal strain steering rack bar according to the present disclosure, and performing nitriding heat-treatment on a surface of the carbon steel composition which is the present disclosure to secure strength.

Therefore, a method for producing the composition of the present disclosure is effectively performed by reducing the number of production steps through a step of filling/drawing a carbon steel combination material for a reduced thermal strain steering rack bar; a broaching step; a nitriding heat-treatment step on a surface; and an inspection step.

FIG. 5 is a picture of a cross-section of a material after high frequency heat-treatment, and the strain of the material occurs after high frequency heat-treatment of the material of the steering rack bar which is the related art. It can be seen that martensite after primary high frequency heat-treatment is transformed to increase a thermal strain amount and thus cause the strain.

Figure 6:
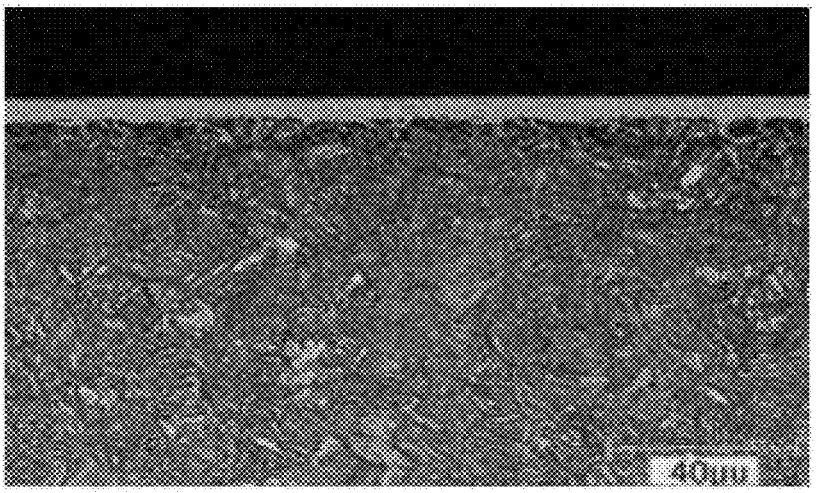
FIG. 6 is an enlarged picture of a material cross-section, which illustrates a material strain after nitriding heat-treatment according to the exemplary form of the present disclosure.

However, FIG. 6 is a picture of a cross-section after nitriding heat-treatment, and if the nitriding heat-treatment step is performed, the thermal strain amount of the outermost surface is reduced.

The following Table 4 is a table where strain amount averages, calibration numbers, and calibration times of the related art and the present disclosure are compared. In the case where high frequency heat-treatment is performed with respect to the carbon steel composition which is the related art, the strain amount corresponds to about 251 μm, the calibration number is about 4 times, and the calibration time corresponds to about 41 seconds. Further, a temperature of SRA heat-treatment corresponds to about 530° C. to increase production costs. However, in the case where nitriding heat-treatment is applied to the carbon steel composition for the reduced thermal strain steering rack bar of the present disclosure, since the strain amount corresponds to approximately 52 μm, calibration work may not be required, and thus the carbon steel composition may be more effectively manufactured. Further, SRA heat-treatment is omitted, and thus production costs are reduced.

TABLE 4

| Classification | | Strain amount average (line measurement, μm) | Calibration number (time) | Calibration time (second) | Note SRA temperature |
|---|---|---|---|---|---|
| Related art | High frequency heat-treatment | 251 | 4.3 | 41 | 530 |
| Present disclosure | Nitriding heat-treatment | 52 | None | None | None |

Therefore, in the case where the manufacturing method of the present disclosure is used, since nitriding heat-treatment is performed, as compared to high frequency heat-treatment, only the surface of the material is cured, and thus the thermal strain due to heat-treatment hardly occurs. Further, strength can be improved, SRA heat-treatment and the calibration work can be removed, and high frequency heat-treatment can be removed one time to simplify a production step and reduce a production time and production costs and thus increase production efficiency.

Hereinafter, the present disclosure will be described in more detail through the exemplary forms. These Examples are only for illustrating the present disclosure, and it will be obvious to those skilled in the art that the scope of the present disclosure is not interpreted to be limited by these Examples.

In one form of the present disclosure, the composition ratio of the carbon steel composition for the steering rack bar is as follows. iron (Fe) is set as the main component, the content of carbon (C) is set to approximately 0.41 wt %, the content of silicon (Si) is set to approximately 0.25 wt %, the content of manganese (Mn) is set to approximately 1.00 wt %, the content of vanadium (V) is set to approximately 0.12 wt %, the content of niobium (Nb) is set to approximately 0.03 wt %, the content of aluminum (Al) is set to approximately 0.11 wt %, and the content of chromium (Cr) is set to approximately 0.15 wt %. In the following Table 5, properties of the carbon steel composition in the related art and the present disclosure are compared.

In the present disclosure, as compared to the related art, tensile strength is improved approximately from 700 MPa to 1000 MPa by about 30%. Further, impact toughness is increased approximately from 3.5 kgf·m/cm$^2$ to 7 kgf·m/cm$^2$ by about 100%, and processability is improved to increase the life-span of the broaching mold. Accordingly, the steering rack bars that had been produced in the number of 4000 by a set of molds are produced in the number of 5000, and thus production costs were improved. Further, yield strength is increased approximately from 629 MPa to 815 MPa by about 30%, and the elongation ratio is improved approximately from 14.3% to 15.2%. In addition to this, hardness is increased approximately from 223 HB to 262 HB, and strength is improved approximately from 6.5 kN to 9.0 kN by about 40%.

TABLE 5

| Classification | Tensile strength (MPa) | Yield strength (MPa) | Elongation ratio (%) | Hardness (HB) | Impact value (kgf · m/cm$^2$) | Strength (kN) |
|---|---|---|---|---|---|---|
| Related art (high frequency heat-treatment) | 798 | 629 | 14.3 | 223 | 3.5 | 6.5 |
| Present disclosure (nitriding heat-treatment) | 1012 | 815 | 15.2 | 262 | 7.02 | 9.0 |

SRA heat-treatment is removed through the reduction in thermal strain, and the step of high frequency heat-treatment of the rear surface is removed by securing strength. In addition, the thermal strain is reduced to reduce the calibration step. Therefore, production efficiency is increased, and the production time and production costs are reduced.

In the case of the material for the steering rack bar in the related art, strength enduring external impact is insufficient and thus high frequency heat-treatment is performed with respect to both the teeth surface and the rear surface.

However, there is a problem in that in the case where high frequency heat-treatment is performed, since the thermal strain excessively occurs, the calibration step for revising this is additionally performed, and thus production costs are increased. However, according to the carbon steel composition for the reduced thermal strain steering rack bar of the present disclosure, production costs may be reduced by adjusting the components added to the carbon steel composition to reduce the number of heat-treatment steps, securing strength through nitriding heat-treatment, and simultaneously, reducing the thermal strain to omit the calibration step.

Moreover, since the steering rack bar manufactured by using the carbon steel composition for the reduced thermal strain steering rack bar of the present disclosure and the manufacturing method of the present disclosure may secure sufficient strength, safety of vehicles may be promoted, and the thermal strain may be reduced to reduce noise of the vehicles and improve steering performance of the vehicles. Accordingly, unnecessary friction of the vehicles may be reduced to improve fuel efficiency.

Forms described may be changed or modified by those skilled in the art to which the present disclosure pertains without departing from the scope of the present disclosure, and various alterations and modifications are possible within the technical spirit of the present disclosure and the equivalent scope of the claims which will be described below.

What is claimed is:

1. A carbon steel composition for a steering rack bar having a nitride layer, the carbon steel composition comprising:

iron (Fe) as a main component;

carbon (C) of approximately 0.39 to 0.43 wt %;

silicon (Si) of approximately 0.15 to 0.35 wt %;

manganese (Mn) of approximately 0.90 to 1.10 wt %;

niobium (Nb) of approximately 0.02 to 0.04 wt %;

vanadium (V) of approximately 0.10 to 0.15 wt %;

chromium (Cr) of approximately 1.00 to 2.00 wt %; and aluminum (Al) of approximately 0.08 to 0.14 wt %, wherein a nitride index N is approximately greater than 10 and less than 20, where the nitride index N is a chromium (Cr)/aluminum (Al) component ratio, and wherein a range of a thickness of the nitride layer is from 7 μm to 12 μm, and a surface hardness maintenance depth thereof is from 50 μm to 65 μm.

2. A steering rack bar manufactured by the carbon steel composition according to claim 1.

* * * * *